US005588658A

United States Patent [19]

Perner et al.

[11] Patent Number: 5,588,658

[45] Date of Patent: Dec. 31, 1996

[54] APPARATUS FOR MOUNTING SKATE ROLLERS IN INLINE ROLLER SKATES

[75] Inventors: Johann Perner, Graz; Gerhard Trinkaus, Voitsberg, both of Austria

[73] Assignee: Koflach Sport Gesellschaft m.b.H. & Co. KG, Austria

[21] Appl. No.: 367,144

[22] PCT Filed: May 9, 1994

[86] PCT No.: PCT/AT94/00062

§ 371 Date: Jan. 10, 1995

§ 102(e) Date: Jan. 10, 1995

[87] PCT Pub. No.: WO94/26367

PCT Pub. Date: Nov. 24, 1994

[30] Foreign Application Priority Data

May 12, 1993 [AT] Austria ..... 935/93

[51] Int. Cl.[6] ..... A63C 17/06

[52] U.S. Cl. ..... 280/11.22; 280/11.27

[58] Field of Search ..... 280/11.22, 11.23, 280/11.27, 11.28, 87.041, 87.042

[56] References Cited

U.S. PATENT DOCUMENTS

| | | | |
|---|---|---|---|
| 5,135,244 | 8/1992 | Allison | 280/11.28 |
| 5,366,232 | 11/1994 | Pozzobon et al. | 280/11.22 |
| 5,441,286 | 8/1995 | Pozzobon | 280/11.27 |

*Primary Examiner*—Richard M. Camby
*Attorney, Agent, or Firm*—Nixon & Vanderhye P.C.

[57] ABSTRACT

In a device for mounting rollers (4) on inline roller skates (1), in which the axles of the rollers (4) extend through openings in a frame (3) and are mounted in a sub-frame (6), whereby the inside diameter of the openings (14) of the frame (3) is larger than the external diameter of the axles (7), and the sub-frame (6) can be secured to the frame (3) in at least two different vertical positions: the sub-frame (6) can be positively secured using an insert member (10) which extends through the frame (3) and the free flanks of the sub-frame (6) in at least two different vertical positions, such that a simple mounting of at least some of the rollers, at different vertical positions on the frame, is possible without the necessity for special tools.

6 Claims, 9 Drawing Sheets

APPARATUS FOR MOUNTING SKATE ROLLERS IN INLINE ROLLER SKATES

The invention relates to a device for mounting rollers in inline roller skates, in which the axles of the rollers extend through openings in a frame and are mounted in a sub-frame which can be secured to the frame, wherein the inside diameter of the openings in the frame are larger than the external diameter of the roller axles, and the sub-frame is capable of securement to the frame in at least two different vertical positions.

An apparatus for mounting rollers in different vertical positions is seen in WO92/10251, for example. In this known apparatus, the main teaching is to adjust the spacing of the axles of the rollers in the longitudinal direction of the skate simultaneously with an adjustment of the vertical position. In the construction also derived from this prior document, the construction including a sub-frame, the vertical adjustment takes place against the force of a spring, using a key which brings about movement of the sub-frame in the vertical direction, while the spring tension increases. The bearing surfaces contact each other eccentrically, and are naturally subjected to a corresponding wear.

The invention has as its aim the provision of an apparatus of the kind described above, with which it is possible to achieve a particularly simple and speedy alteration of the vertical position with considerable stability and without requiring particular tools, and simultaneously to accomplish a quick exchange of rollers or other components subject to wear. To achieve this aim, the construction in accordance with the invention is principally characterized in that the sub-frame is capable of positive securement in at least two different vertical positions using an insert member extending through the frame and the free flanks of the sub-frame. By providing that the sub-frame is positively securable in two different vertical positions using an insert member extending through the frame and the free flanks of the sub-frame, a secure clamping in the various desired positions is achieved utilizing a simple insert member, such that the forces are adsorbed with high precision in the various openings of the sub-frame. Because of the positive grip on the free flanks or the openings of the free flanks of the sub-frame, there is also attained a uniform absorption of forces, and therefore a substantially reduced degree of wear. At the same time, this construction makes possible a simple release of the connection without requiring substantial force and without the use of particular tools, in which the construction has, moreover, the advantage of providing all of the prerequisites for the use of damping members with different damping characteristics as components for desired vertical adjustments.

In a particularly simple manner, the construction according to the invention is so arranged that the mounting of the sub-frame to the frame is accomplished utilizing an eccentric which projects through the free flanks of the sub-frame and the frame, this construction having the advantage of making possible an adjustment of the vertical position without going through intermediate stages. By virtue of the positive grip within an opening of the free flanks of the sub-frame, a full absorption of force is possible without eccentric and wear-increasing stresses.

In accordance with a further advantageous modification, the construction is primarily characterized in that the different vertical positions of the sub-frame relative to the frame are delimited by elastic inserts such as spacers between the web connecting the free flanks of the sub-frame and the sole or interior of the frame. Such elastic inserts can be of different stiffness and can have different material properties, especially a differing shore-hardness or different moduli of elasticity, such that along with a height adjustment of the sub-frame, the damping characteristics can also be favourably adjusted. Moreover, by selecting an appropriate damping, the wear-stresses can be significantly reduced. The latter use of an elastic insert can be carried out in a very simple way by arranging for the flanks of the sub-frame, in the region of the bridging portion, to have at least one aligned opening for an insert member insertable through the opening and externally gripping the bridge, such that again a simple insert component can absorb all arising forces, without requiring any particular tool for the replacement or adjustment procedure. It is particularly advantageous to arrange the construction such that the insertable insert member exhibit a slot which extends parallel to the longitudinal axis of the insert member but is spaced from that longitudinal axis, in which the positioning of the slot in spaced relation from the longitudinal axis makes possible two definite positions with each of which a different vertical mounting of the sub-frame can be obtained.

Through the use of an eccentric, as already mentioned above, a height adjustment is possible without intermediate stages. In order to ensure a secured tensioning and a full absorption of the arising forces without the help of particular tools, the construction may advantageously be such that the eccentric carries at one free end a tension lever which is pivotable about an axis running transverse to the longitudinal axis of the eccentric, the tension lever having a cam surface which, when the tension lever is pivotably moved, exerts a tension force against one outer surface of the frame.

In what follows, the invention will be set forth in greater detail utilizing the example embodiments schematically illustrated in the drawings.

Figure 1:
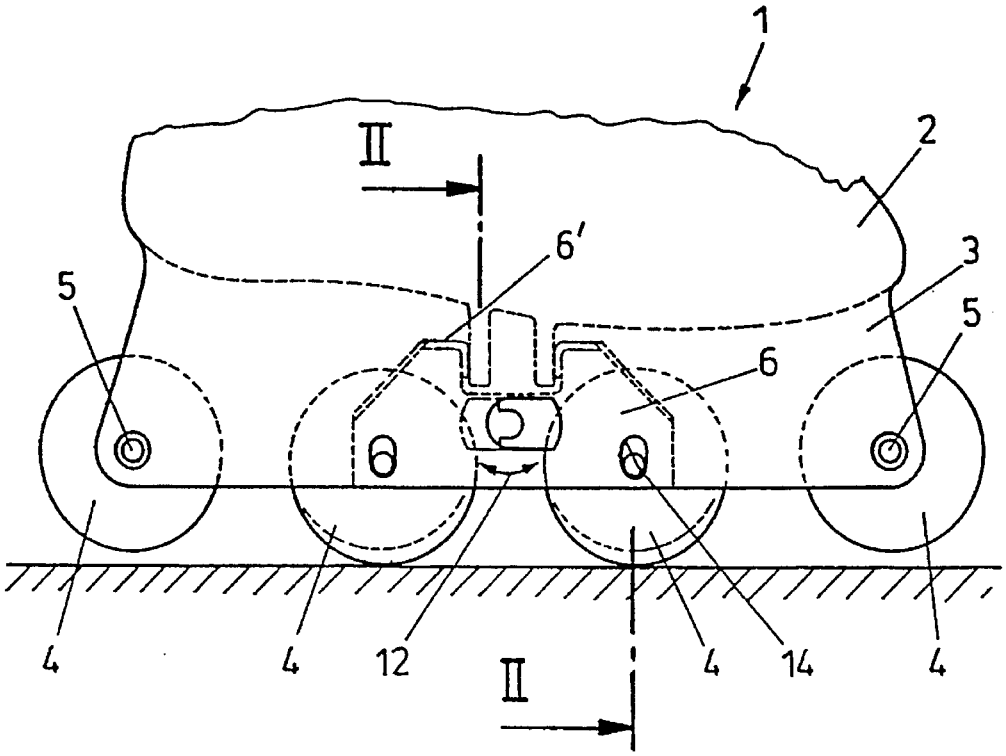
FIG. 1 shows, in a schematic illustration, an inline roller skate with a construction according to the invention.
Figure 2:
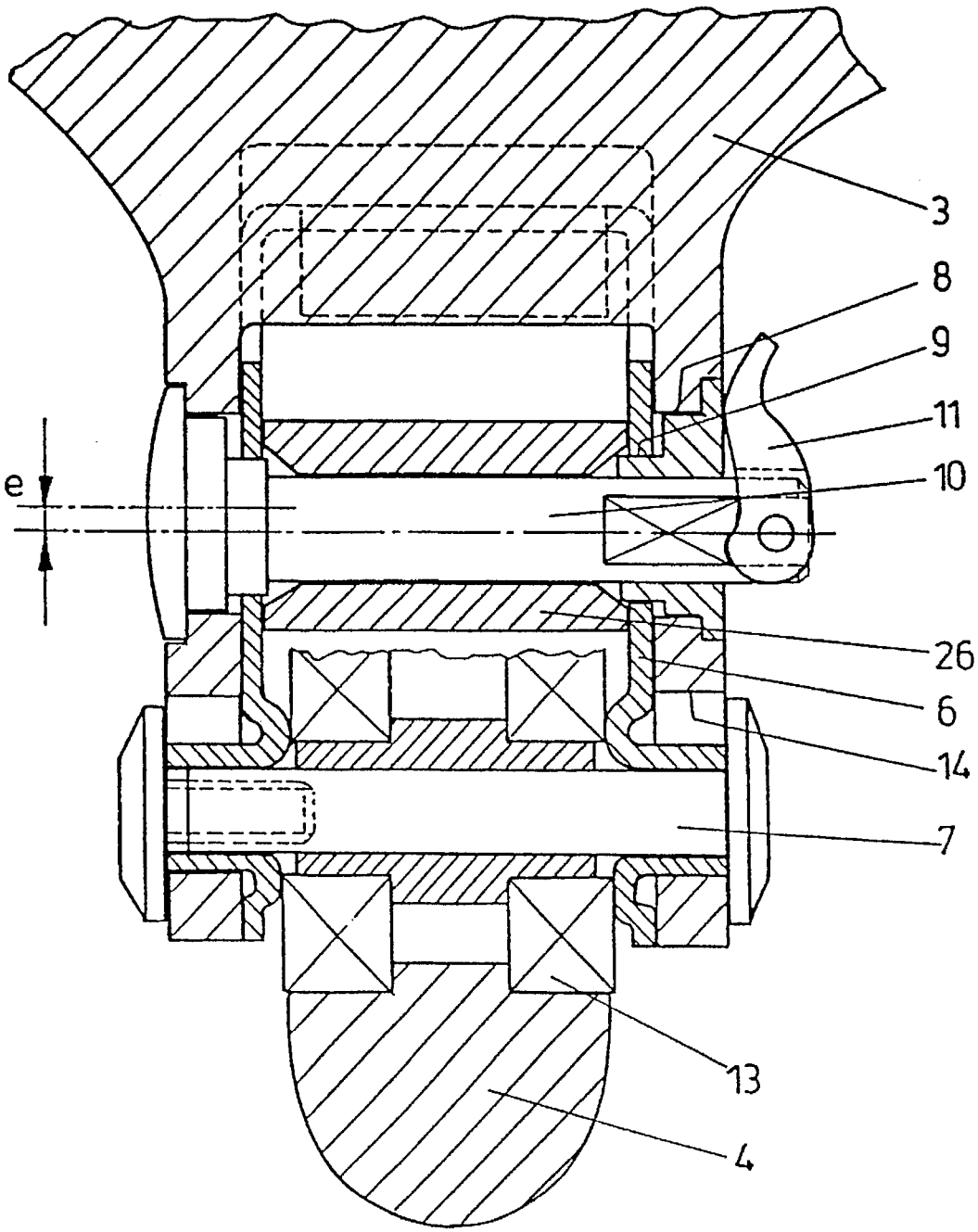
FIG. 2 is a sectional view taken at the line II—II in FIG. 1, to a larger scale.

In FIGS. 1 and 2 there is schematically illustrated an inline roller skate 1 in which a plurality of aligned rollers 4 is rotatably mounted in a frame 3 which may be either fastened to the skate upper 2 or integral therewith. The furthest forward and furthest rearward rollers are directly mounted to the frame about the rotary axes 5. The intermediate rollers are rotatably mounted about axes 7 on a sub-frame 6, which for example can be constructed as a stamped part from sheet metal, wherein the sub-frame 6 can be secured to the frame 3 at different vertical positions, as illustrated in broken lines at 6' in FIGS. 1 and 2.

The securement of the sub-frame 6 at different vertical positions is achieved with an insert member 10 mounted within a spacer sleeve 26 and extending both through corresponding openings 8 in the frame 3 and through an opening 9 in the sub-frame 6, wherein the insert member 10 is eccentrically mounted, with the eccentricity being shown at e. A simple actuation of the insert member 10, in order to secure the sub-frame at different vertical positions, is attained through the use of a tension lever 11, which in FIG. 2 is shown as rotated through 90° by comparison with the illustration of FIG. 1. By moving the insert in the sense of the double arrow 12 in FIG. 1 it is possible to secure the intermediate rollers 4 at different vertical positions without requiring additional tools.

As is known per se, the rollers 4 are mounted in bearings 13, and the axle 7 extends through both the sub-frame 6 or its free flanks and also through corresponding openings 14 in the frame 3, wherein it is clearly seen that the openings 14 are basically formed as oblong holes which make possible a corresponding adjustment of the intermediate rollers along with the sub-frame 6 with respect to the frame 3 and to the forward and rearward rollers.

Figure 3:
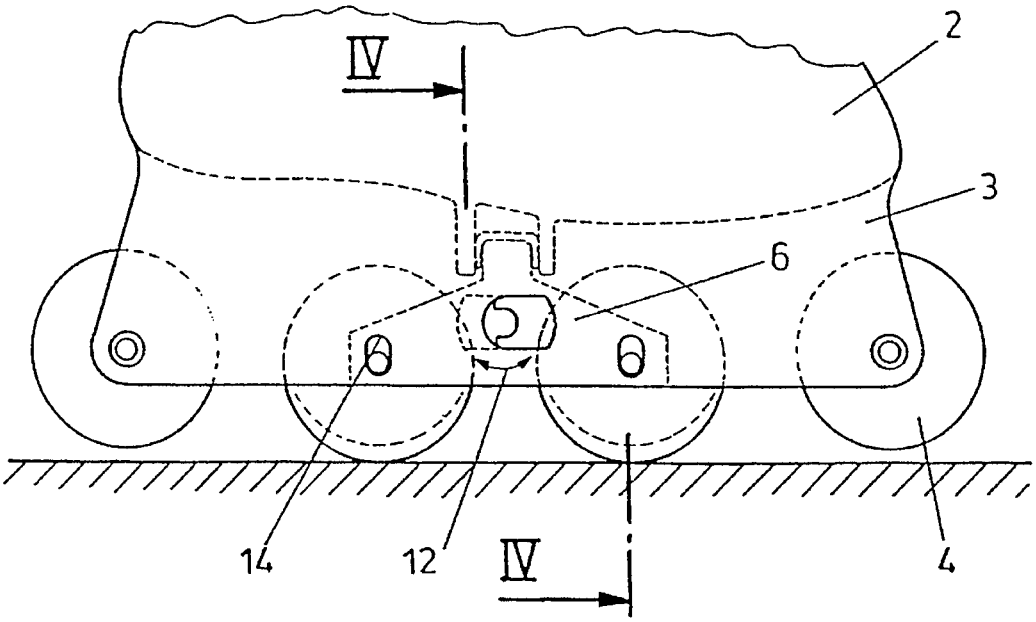
FIG. 3 shows an illustration, similar to that of FIG. 1, of a modified embodiment.
Figure 4:
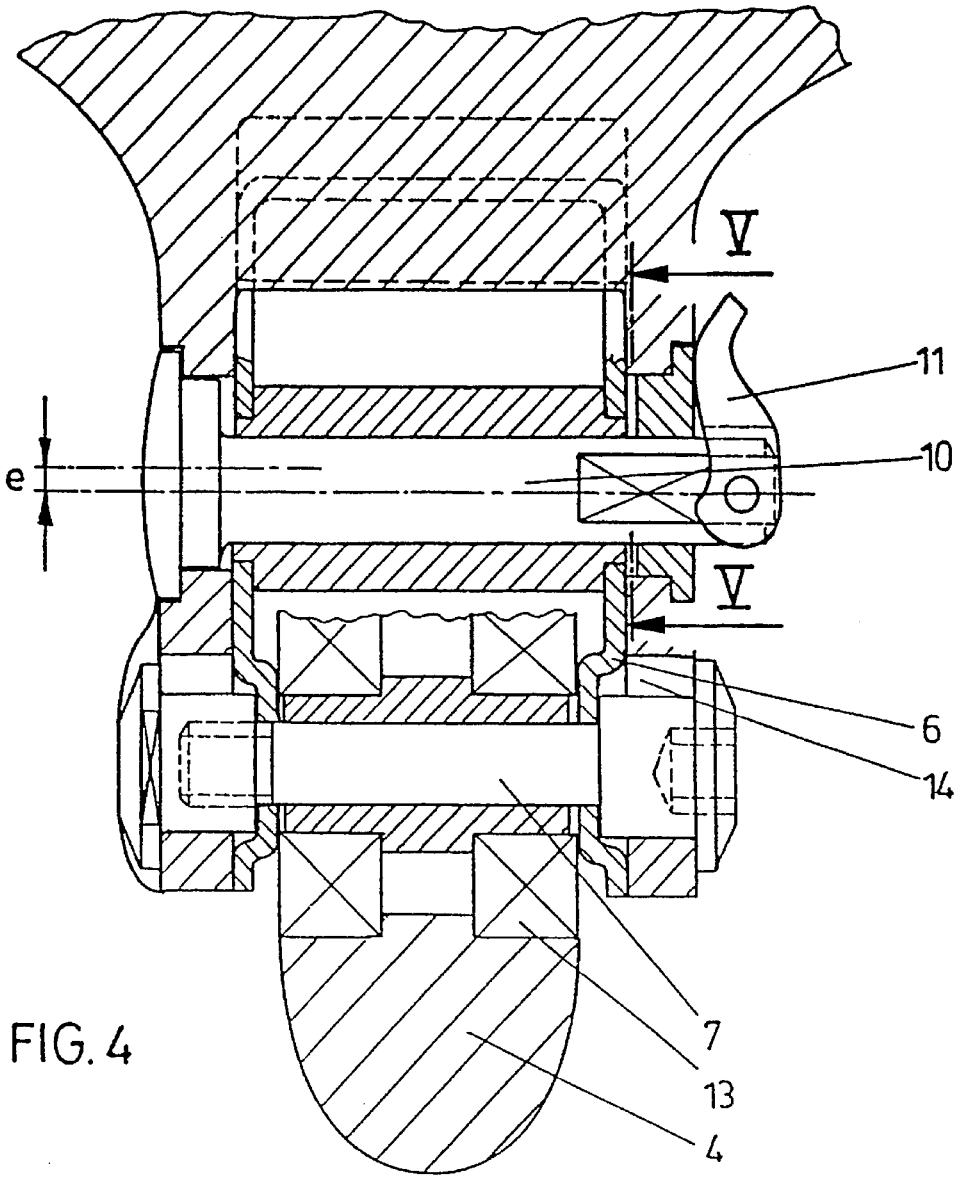
FIG. 4 is a sectional view taken at the line IV—IV in FIG. 3.
Figure 5:
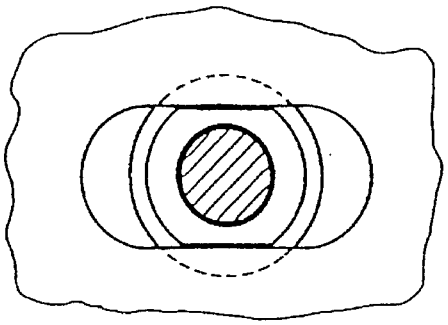
FIG. 5 is a partial section taken at the line V—V in FIG. 4.

In the modified embodiment illustrated in FIGS. 3–5, components which are unchanged from the previously described embodiment retain the same reference numerals. In this embodiment as well, the securement of a sub-frame 6 in different vertical positions by using an eccentric insert member 10, in which again the member 10 can be secured in a simple manner utilizing a tension lever.

Figure 6:
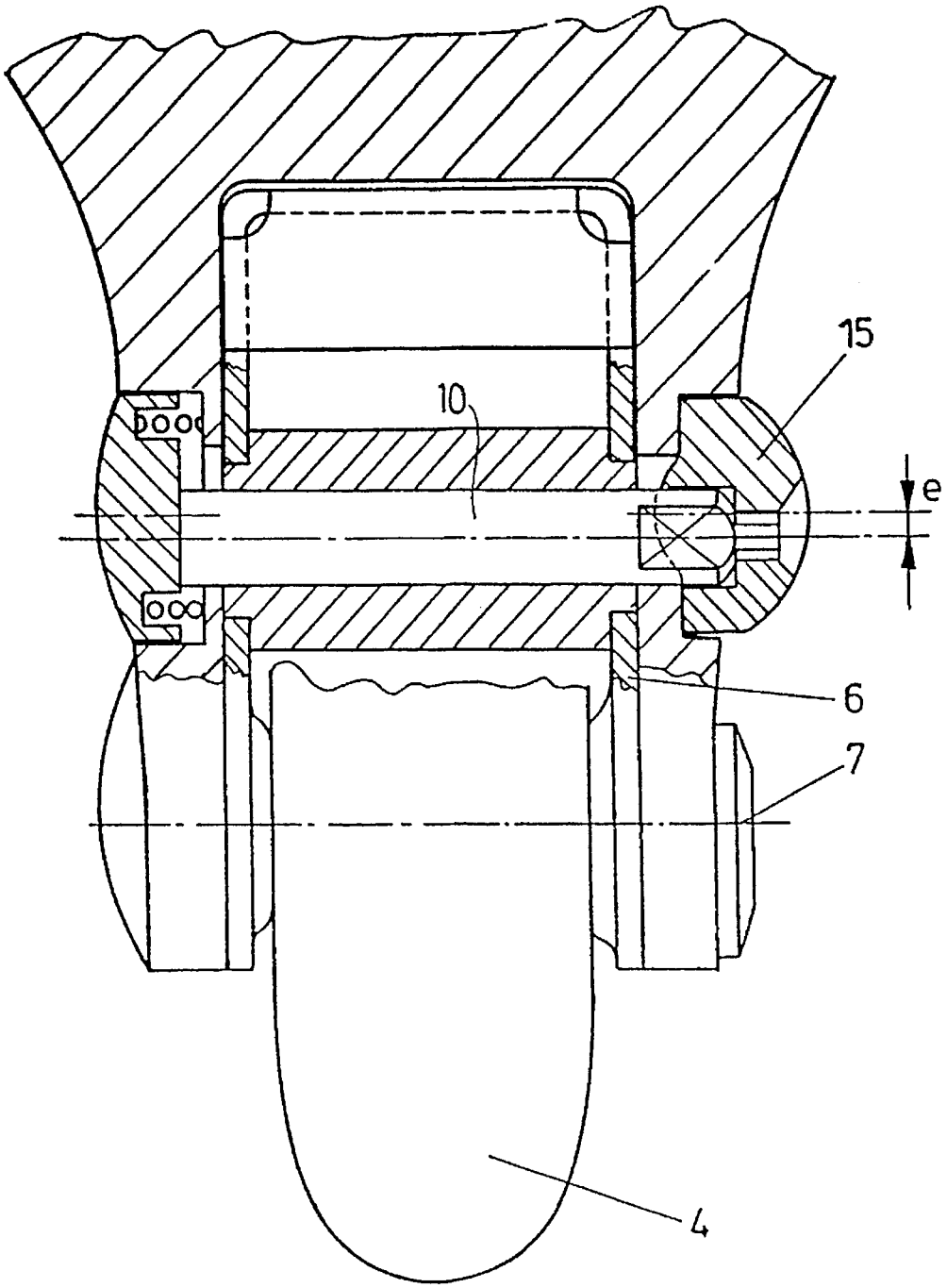
FIG. 6 shows an illustration, similar to that of FIG. 4, of a modified embodiment of a structure in accordance with the invention.

In the modified embodiment illustrated in FIG. 6, use is made of a rotatable head 15 instead of a tension lever 11 in order to adjust the eccentric insert member 10, so that again without any requirement for a special tool, it is possible by a simple rotation of a particular component to achieve different vertical mounting locations for the sub-frame 6 as well as for the rollers 4 mounted thereto.

Figure 7:
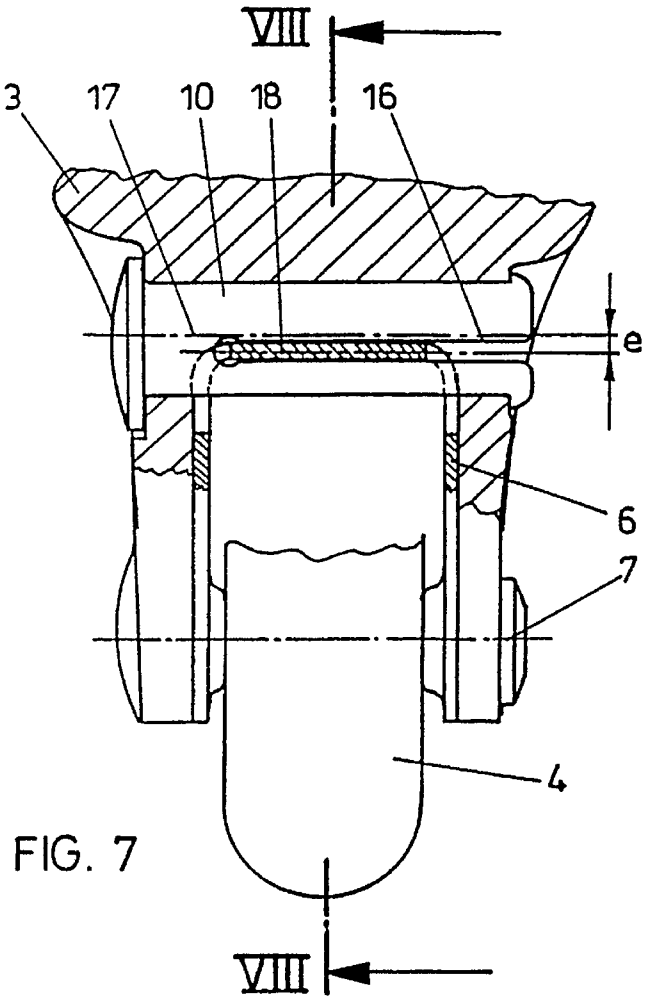
FIG. 7 is an illustration, also similar to that of FIG. 4, of a modified embodiment of a structure in accordance with the invention.
Figure 8:
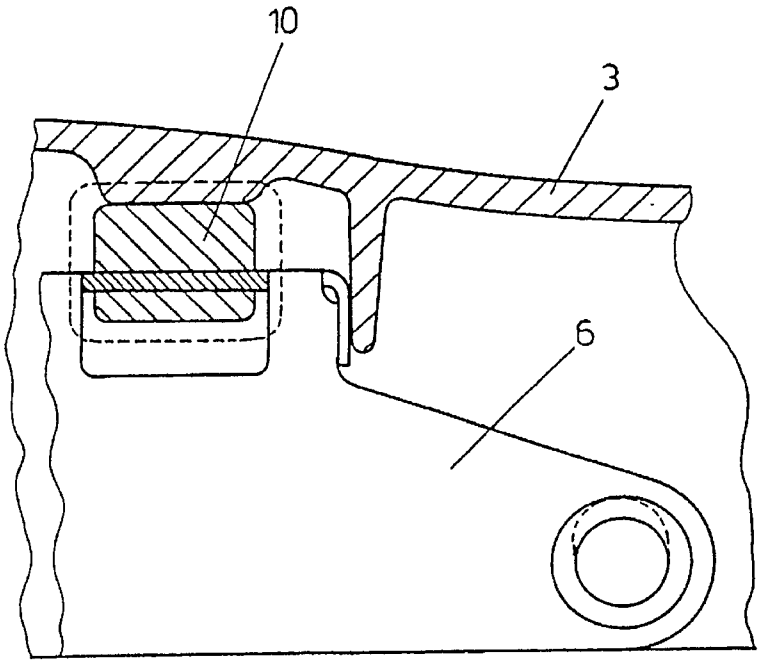
FIG. 8 shows a sectional view taken at the line VIII—VIII in FIG. 7.

In the example embodiment according to FIGS. 7 and 8, the insert member 10 extending through the frame 3 as well as through the sub-frame 6 is provided with a slot 16 which runs parallel to the axis of the member 10 shown schematically at 17, but which is spaced from the said axis by an offset e. By cooperation, or the insertion of the insert member 10 with respect to the bridge 18 connecting the free flanks of the sub-frame 6, there is again obtained a securement of the sub-frame 6 at different vertical positions relative to the frame 3. Additionally, in this embodiment there are provided damping elements in the region of the insert member provided with the slot 16.

Figure 10:
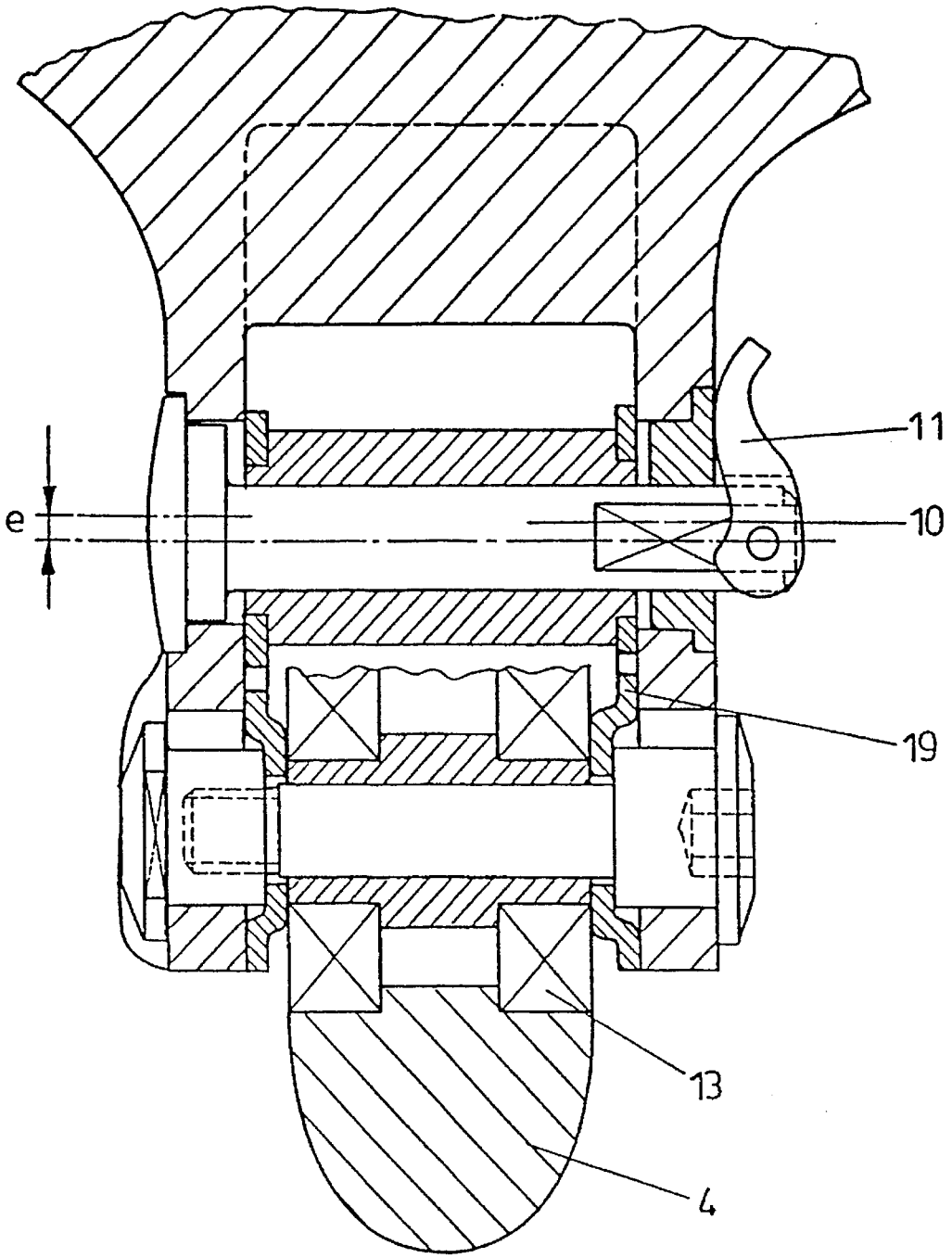
FIG. 10 is a sectional view taken at the line X—X in FIG. 9.
Figure 9:
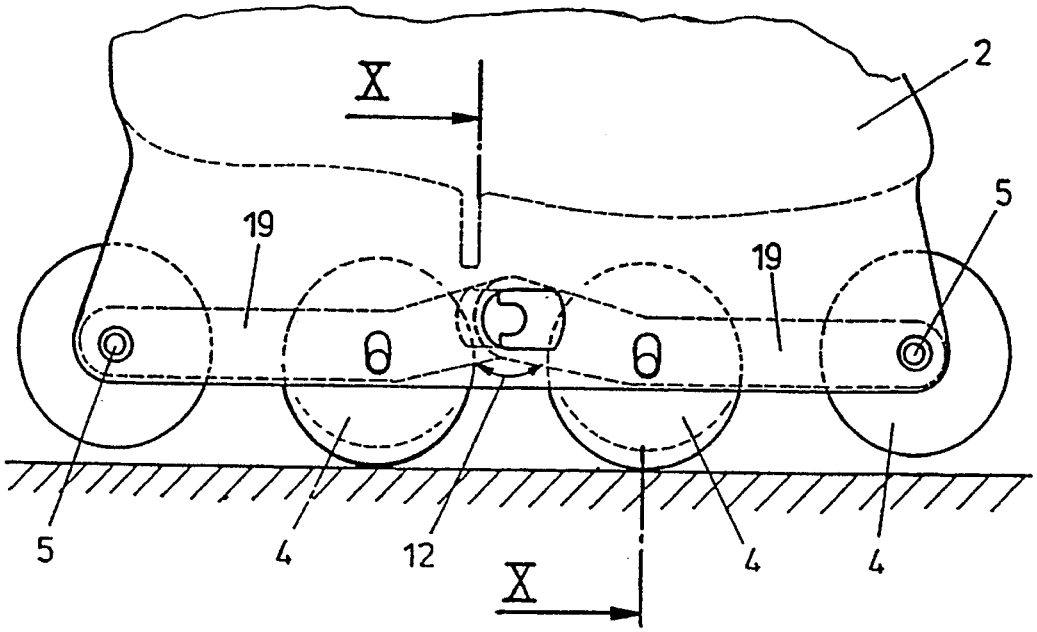
FIG. 9 shows, in an illustration similar to that of FIG. 1, a further modified embodiment of an inline roller skate with a structure in accordance with the invention.

In the embodiment according to FIGS. 9 and 10, the intermediate, height-adjustable rollers are mounted in sub-frames 19 which are separate from each other, wherein the individual sub-frames 19 are pivotally mounted, respectively, about the axes 5 of the forward and rearward rollers. Adjustment of the vertical position of the sub-frame 19 is again effected utilizing an eccentric insert member 10 which, in accordance with the illustration of FIG. 10, can be secured in position utilizing a tension lever 11. By adjusting the insert member 10 in the sense of the double arrow 12, it is again possible to secure the intermediate rollers in different vertical positions.

Figure 11:
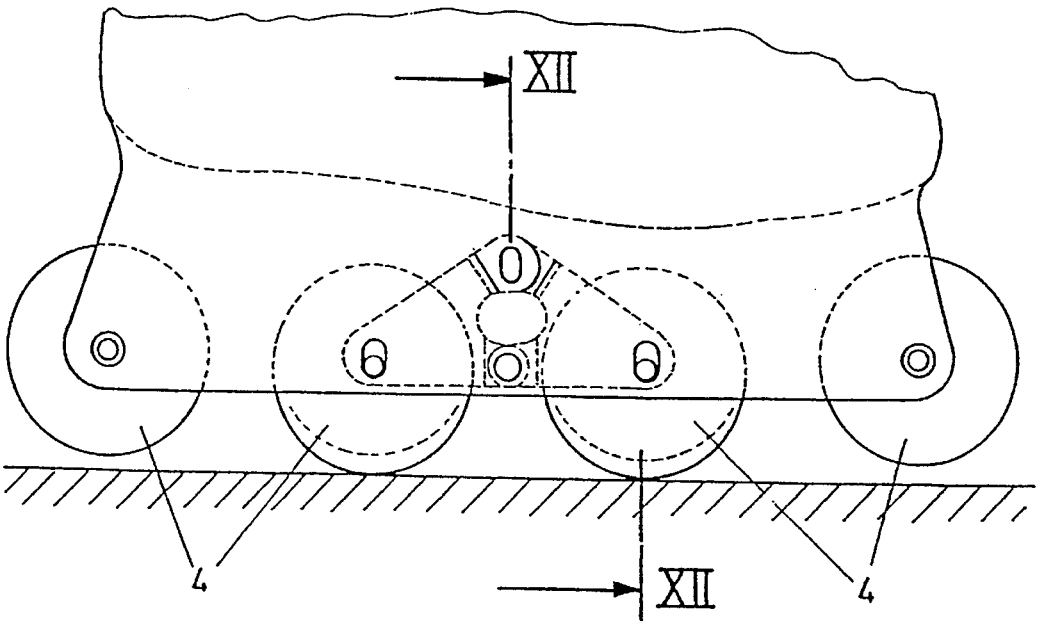
FIG. 11 shows, in an illustration similar to that of FIG. 1, a further modified embodiment of an inline roller skate with a structure according to the invention.
Figure 12:
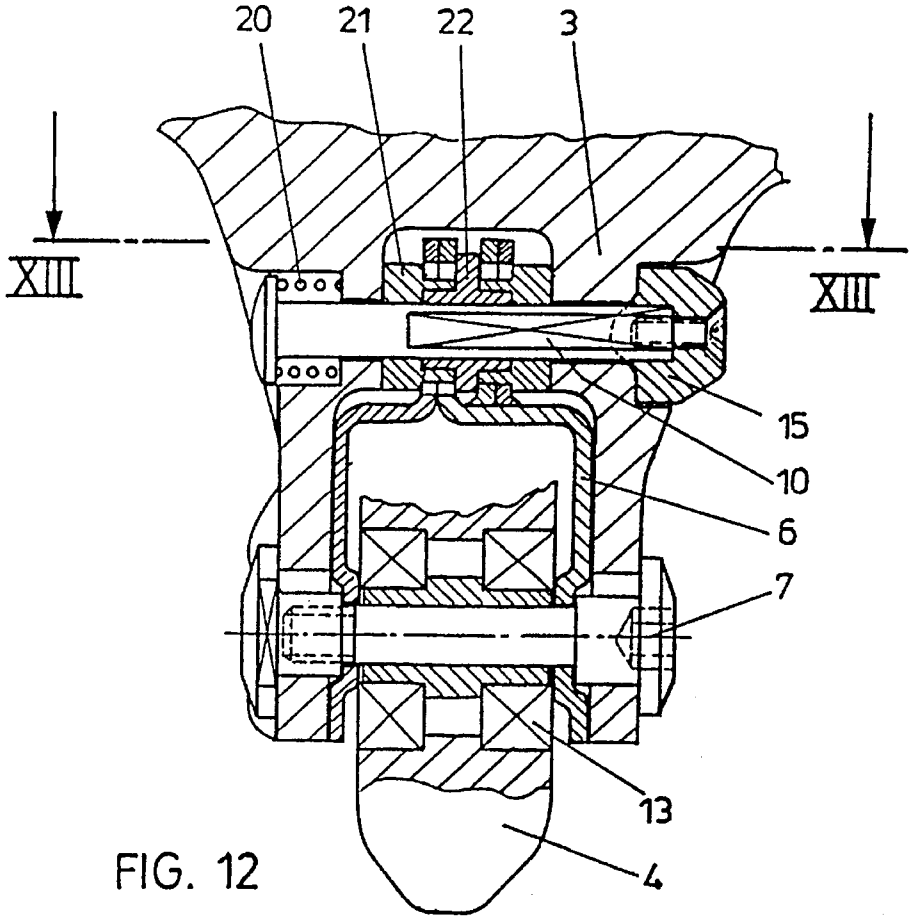
FIG. 12 is a sectional view taken at the line XII—XII in FIG. 11.
Figure 13:
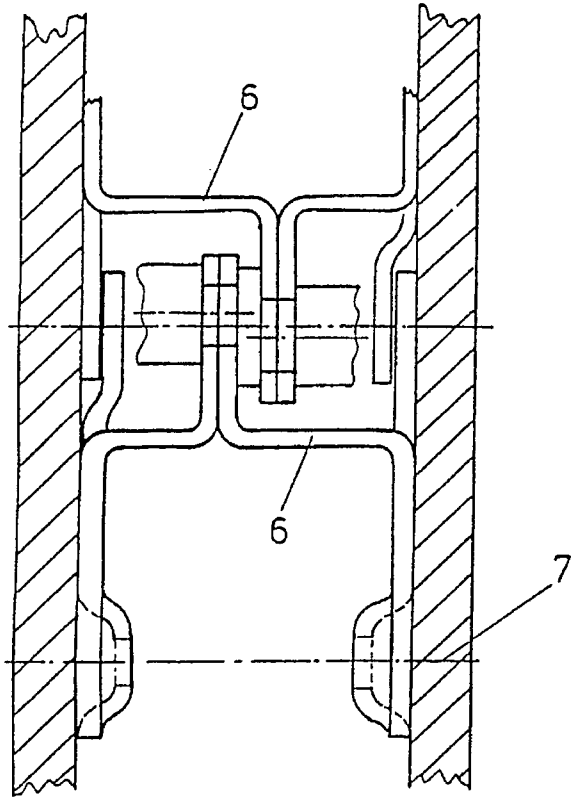
FIG. 13 shows a partial section taken at the line XIII—XIII in FIG. 12.

In the embodiment according to FIGS. 11 to 13, there is again used an insert member 10 which can be actuated utilizing a rotational head 15 similar to the embodiment according to FIG. 6. The insert member 10 is mounted so as to bear against the force of a spring 20, and again extends through openings in the frame 3 as well as through a sleeve 21 connected with the sub-frame 6. A double eccentric is schematically indicated at 22, and is shown in greater detail in FIG. 13. In this drawing, there is illustrated a wheel axis 7, and one can see immediately from this drawing the arrangement of the individual sub-frames 6 which support the intermediate rollers 4.

Figure 14:
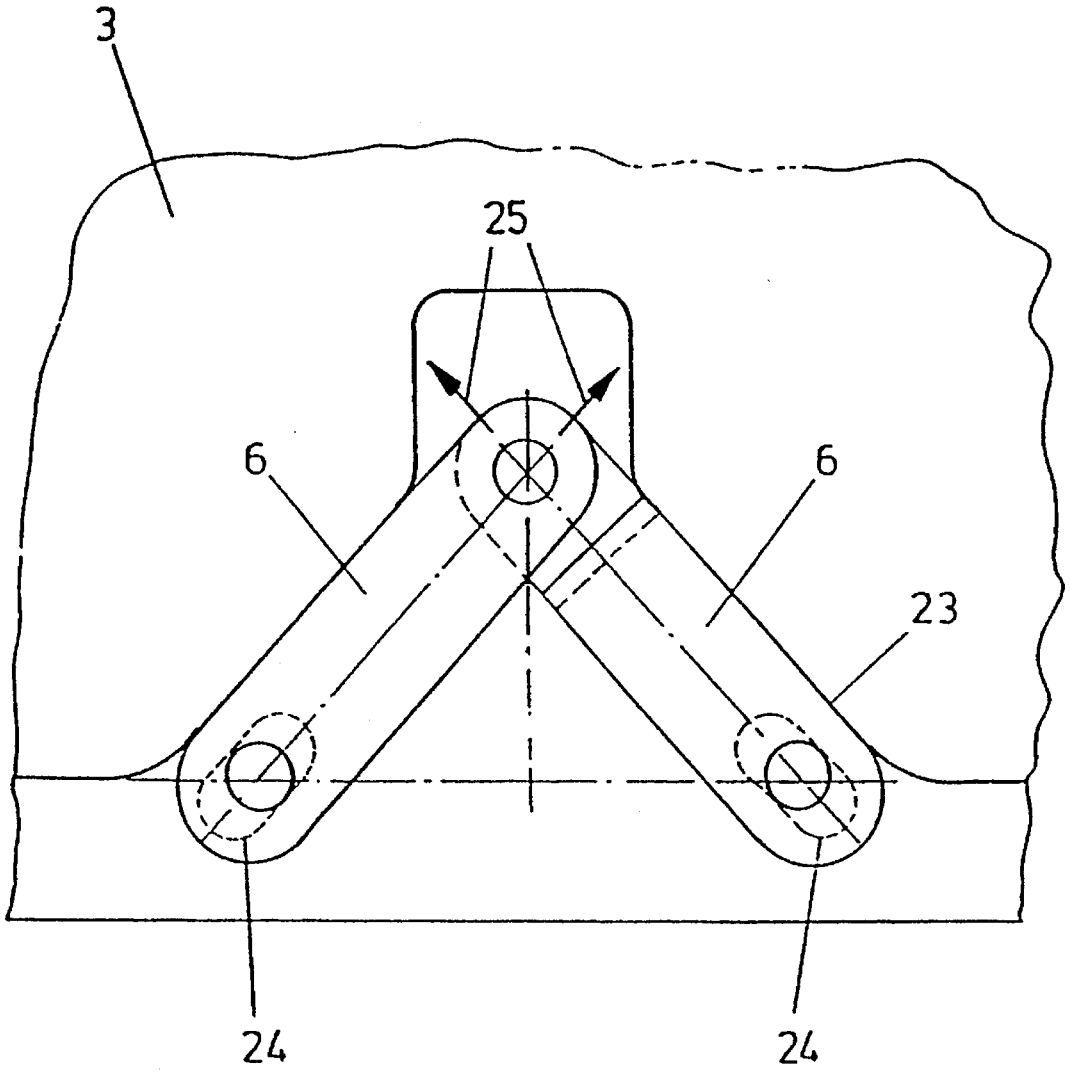
FIG. 14 is a schematic illustration of a further modified embodiment of a construction in accordance with the invention.

In the schematic illustration shown in FIG. 14 it can be seen that the sub-frame elements 6 cooperating with the eccentric are both guided along the inside of a slope 23 and both have an oblong opening 24, so that here again the actuation of the eccentric along the arrows 25 allows a height adjustment of the intermediate rollers.

We claim:

1. A device for mounting rollers in inline roller skates, in which the roller axles extend through openings in a frame and are mounted in a sub-frame, in which the inner diameter of the openings in the frame is larger than the outer diameter of the roller axles, and the sub-frame can be secured to the frame in at least two different vertical positions, characterized in that, the sub-frame (6, 19) is positively lockable in at least two different vertical positions using an insert member (10) extending through the frame (3) and free flanks of the sub-frame (6, 19).

2. A device according to claim 1, characterized in that, the securement of the sub-frame (6, 19) on the frame (3) is attained using an eccentric provided on the insert member (10) or cooperating therewith, the eccentric projecting through the free flanks of the sub-frame (6, 19) and the frame (3).

3. A device according to claim 1, characterized in that, the different vertical positions of the sub-frame (6) relative to the frame (3) are delimited by elastic insert members or pins (10) securable to the sub-frame (6), such as spacers between the bridge (18) connecting the free flanks of the sub-frame (6) and the sole of the roller skate (1) or inside of the frame (3).

4. A device according to claim 1, characterized in that, the flanks of the sub-frame (6) in the region of the bridge (18) of the sub-frame (6) have at least one aligned recess for an insert member (10) which is insertable through the openings and externally engages the bridge (18).

5. A device according to claim 4, characterized in that, the insertable insert member (10) has a slot (16) which extends parallel to the longitudinal axis (17) of the insert member (10), the slot (16) being spaced from said longitudinal axis (17).

6. A device according to claim 2, characterized in that, the eccentric (22) supports at one free end a pivotable tension lever (11) which extends transverse to the longitudinal axis of the eccentric (22) and exhibits a cam surface which, when the tension lever (11) is pivoted, exerts a tension force against an outer surface of the frame (3).

* * * * *